United States Patent [19]

Rudell

[11] 4,390,184

[45] Jun. 28, 1983

[54] GOLF PUTTER HEAD AND PUTTER INCORPORATING SUCH HEAD

[76] Inventor: David C. Rudell, 362 South Creek Dr., Depew, N.Y. 14043

[21] Appl. No.: 302,529

[22] Filed: Sep. 16, 1981

[51] Int. Cl.[3] ..... A63B 69/36

[52] U.S. Cl. ..... 273/183 D; 273/164

[58] Field of Search ..... 273/164, 169, 183 D, 273/183 E, 167 D, 167 R, 167 E, 193 R, 194 R, 194 A, 170, 171, 167 A; D21/219

[56] References Cited

U.S. PATENT DOCUMENTS

| | | | |
|---|---|---|---|
| D. 202,715 | 11/1965 | Solheim | D34/5 |
| D. 207,227 | 3/1967 | Solheim | D34/5 |
| D. 207,228 | 3/1967 | Solheim | D34/5 |
| D. 209,761 | 1/1968 | Solheim | D34/5 |
| D. 228,563 | 10/1973 | Brower | D34/5 GH |
| D. 229,844 | 1/1974 | Pavelle | 273/167 D |
| D. 232,371 | 8/1974 | Becker | D21/2 |
| D. 239,402 | 3/1976 | Kindred | D34/5 GH |
| D. 244,303 | 5/1977 | Cabot | D21/2 |
| D. 247,381 | 2/1978 | Adkins | D21/2 |
| D. 247,382 | 2/1978 | Adkins | D21/2 |
| D. 248,783 | 8/1978 | Long | D21/2 |
| 3,384,376 | 5/1968 | Greenlee | 273/193 R |
| 3,516,674 | 6/1970 | Scarborough | 273/169 |
| 3,873,094 | 3/1975 | Sebo et al. | 273/163 R |
| 3,880,430 | 4/1975 | McCabe | 273/183 D |
| 3,953,033 | 4/1976 | Kelly et al. | 273/183 E |
| 3,966,210 | 6/1976 | Rozmus | 273/169 |
| 3,967,826 | 7/1976 | Judice | 273/167 |
| 4,034,989 | 7/1977 | Stewart | 273/164 |
| 4,043,562 | 8/1977 | Shillington | 273/164 |
| 4,199,144 | 4/1980 | Skelly | 273/164 |
| 4,253,667 | 3/1981 | Clark et al. | 273/171 X |

OTHER PUBLICATIONS

"Golf World", Jul. 2, 1976, p. 31.

*Primary Examiner*—George J. Marlo
*Attorney, Agent, or Firm*—Raymond F. Kramer

[57] ABSTRACT

A golf putter head of substantially squared W-shape, when viewed from the top thereof, preferably with weights in the outer leg portions of such W, facilitates straighter and more accurate putting. When the walls of the middle leg of the W of the club head (or the middle trailing portion of such head) slope endwardly and downwardly a golfer may correctly position his head above the putter and the ball by viewing the slope areas and moving his head position until such areas appear equal (or in desired ratio). Preferably, the putter head includes internal weights in upper portions so located that the vertical center of gravity of the putter head, in putting position, is at or above the midpoint of a ball to be putted.

14 Claims, 6 Drawing Figures

GOLF PUTTER HEAD AND PUTTER INCORPORATING SUCH HEAD

This invention relates to a golf club. More particularly, it relates to a putter head and to a putter including such a head.

In the game of golf it has long been recognized that good putting is vital for low scoring. While long drives and accurate approach shots are important, professional golfers who are poor putters rarely win championships or tournaments. Conversely, the better putters are often victorious over stronger, longer driving competitors. Most professional golfers are excellent putters and are capable of holding the club squarely and of taking it back and stroking the ball in smooth straight motions. On the other hand, many amateur golfers have difficulties in developing a consistently straight and smooth "grooved" stroking motion, and consequently their putting is often erratic. Other problems facing the amateur golfer include correctly positioning his head over the putter and the golf ball, aligning the putter with the golf ball and stroking the ball squarely and so as to impart a forward roll to it.

Various types of golf clubs have been produced in efforts to help golfers solve putting problems. Guide lines and markings have been incorporated in putters so as to indicate the "sweet spot" of the club, at which contact with the ball should be made, and to assist in aligning the club with respect to the desired path of the ball. For example, see U.S. Pat. Nos. 3,880,430; 3,966,210; and 4,199,144; and U.S. Pat. Nos. De. 202,715; 203,509; 228,563; 244,303; and 247,381. Shapes of the putter head in the "trailing" part thereof have been altered in attempts to favorably relocate the sweet spot or center or gravity of the head and to affect the moment of inertia thereof so as to help prevent the effect on club head movement of the torque developed when the head strikes the ball off center or off the sweet spot. Illustrative of such head modifications are U.S. Pat. Nos. 3,966,210; 3,967,826; and 4,199,144; and U.S. Pat. Nos. De. 202,715; 207,228; 209,761; 232,371; 239,402; 244,303; 247,381 and 248,783. In U.S. Pat. Nos. 3,516,674; 3,873,094; and 3,966,210 weights have been employed to modify club head characteristics to improve putting performance. In U.S. Pat. No. 3,880,430 there is shown a club head structure which helps a golfer to align his head with respect to the club head, while putting, and in U.S. Pat. No. 3,953,033, for a putting stance analyzing device, a sight tube is utilized for said purpose (but of course it cannot be employed in actual play). Finally, an insert in the contact face of the club head is shown in U.S. Pat. No. 4,199,144, said insert being of material different from that of the rest of the club head, and extending for most of the part of the club head surface that is capable of contacting a golf ball during putting.

Although, as described previously, various means have been employed to assist the golfer in putting consistently, and although putters incorporating such means have met with varying degrees of success, the present invention, which is for a novel and unobvious club head, is of a structure which satisfactorily mechanically and aesthetically embodies principles of stroke control and thereby usefully improves a golfer's putting capability and increases his percentage of consistency in his putting stroke.

In accordance with the present invention a golf putter comprises a handle, a head and a shaft connecting said handle and head, with the putter head having a leading side portion with a substantially vertical leading surface for putting a golf ball and three separate trailing portions extending backwardly from the leading side portion, two of which extend from end portions of the leading side portion of the putter and the third of which extends from a middle portion of said leading side portion, said third trailing portion including endwardly and downwardly sloping walls, so that a golfer, putting with the putter, can be guided by them to position his head with respect to both the putter and a ball to be putted by holding his head with respect to the putter in such position that a desired ratio of areas of the sloping sides of the middle trailing portion may be viewed by him when his head is in correct position with respect to the putter and a golf ball to be putted. The desired putting position is with the golfer's eyes over the ball to be stroked. As is seen from the previous description of the invention the novel and unobvious aspect thereof is the putter head. In a preferred embodiment of the invention weights are distributed in a desirable manner in the trailing portions of the putter head, the sloping walls of the middle trailing portion are marked near the tops and/or bottoms thereof to facilitate area comparisons and easier positioning of the golfer's head with respect to the putter, in some cases the slopes are modified by additions of wedge-shaped pieces to the club head, and the contacting face of the putter is of wood, with the rest of it being aluminum and with the aluminum surface being anodized. In a broader aspect of the invention the club head is generally substantially of square-W or E shape.

The invention will be readily understood by reference to this specification, including the drawing, in which.

Figure 1:
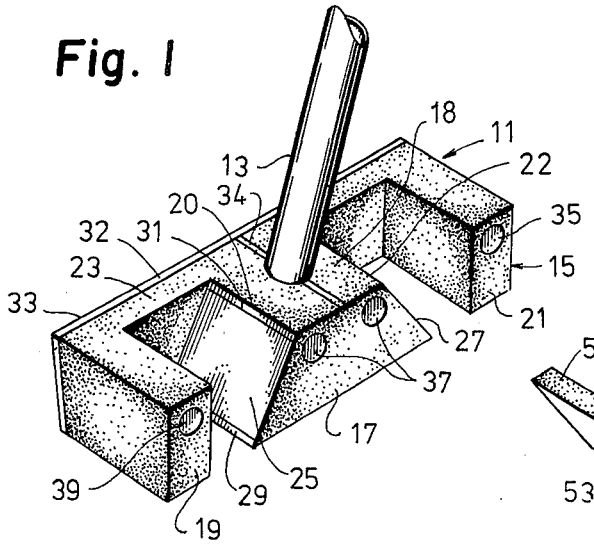
FIG. 1 is a perspective view, seen from a location toward the top and back thereof, of a club head of this invention joined to a club head shaft, only part of the shaft being shown.

In FIG. 1 numeral 11 denotes a golf club of this invention, herein shown as a portion of a putter, including a club head part 15 and part of a shaft 13, with the handle not being shown because it is irrelevant to important and novel aspects of the invention. Club head 15, as illustrated, includes leading side portion 23, having a substantially vertical leading surface portion 32 with a leading surface 33 thereof, a middle trailing portion 17 and end trailing portions 19 and 21. The substantially vertical leading surface portion and leading surface may be inclined slightly, e.g., up to 5° from vertical, preferably 2° to 3° back from the stroke direction at the putter top, if inclined, to impart a desired roll to the ball, and also for manufacturing reasons. The trailing and side portions may also be similarly sloped, usually for manufacturing reasons. Such inclinations are considered to be within the scope of "substantially vertical." It will be seen that the putter head, viewed from the top (as in FIG. 3) or from the bottom (as in FIG. 4), is shaped substantially like a squared letter W. The middle trailing portion 17 of the club head includes endwardly and downwardly extending sloping walls 25 and 27 which, as shown, are symmetrically positioned so that a golfer who is putting with the putter may be guided by his view of equal portions of slopes 25 and 27, so that he will maintain his head in alignment with the putter head and a ball to be putted. Alignment groove or mark 34 assists in such alignment and indicates the desired position of the club head with respect to the axis of a golf ball to be putted. However, even if the groove or mark is omitted, the longitudinal (with respect to stroke direction) edges 20 and 22 of middle top surface 18, and/or marks 31 and 41 facilitate putter alignment with the ball and hole. Marks 29 and 31 (similar marks 41 and 43 appear on face 27) are provided to assist the golfer in defining the areas of the sloping sides to be compared by him during positioning of the putter. Weights 35, 37 and 39, shown horizontally positioned in upper locations of the trailing portions of the club head, extend from the rear or trailing faces thereof toward the front or leading portion but normally will not extend into such leading portion. Such locations are chosen because of the desirability of raising the vertical center of gravity of the club head so as to facilitate the stroking of a good rolling putt. Although the weights are indicated to be cylindrical, fitting in matching openings, it is also within the invention to make them rectangular, square or of other geometric cross-sectional shape and it is within the invention to make the weights fixedly adjustable, as by use of a tightening nut on a threaded rod for holding different numbers or sizes of weights. The cavities for the weights may extend into the club head bottom section but such cavities and others also in such section may be left empty to help to raise the club head center of gravity to at or above the ball center without requiring the putter head to be unacceptably high.

Figure 2:
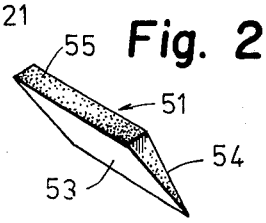
FIG. 2 is view from a similar vantage point of a wedge-like member intended for installation on the club head of FIG. 1 to modify the alignment means viewing characteristics thereof.

In FIG. 2 wedge-like member 51 is illustrated, suitable for installation on club head 15 of FIG. 1 by applying surface 53 of the wedge-like member to surfaces 27 of the club head, so that the wedge surface 55 is continuous with top surface 18 of the middle trailing portion 17 of the club head. Thus, the angle between the base portion 50 (FIG. 4) of middle trailing portion 17 and the face 54 of wedge-shaped member 51 opposite surface 53 will be increased, making the visible part of face 54 smaller, thereby, in some cases, aiding comparison of the area of such face visible to a putter standing over the club and ball to a corresponding area of a corresponding surface of another such wedge installed on face 25 of the putter head. Of course, face 54 of wedge 51 and the corresponding face of the oppositely installed wedge will also preferably be marked or scored with horizontal lines or other suitable indicia near the tops and bottoms thereof, like 29 and 31, and 43 and 41 (FIG. 3).

Figure 3:
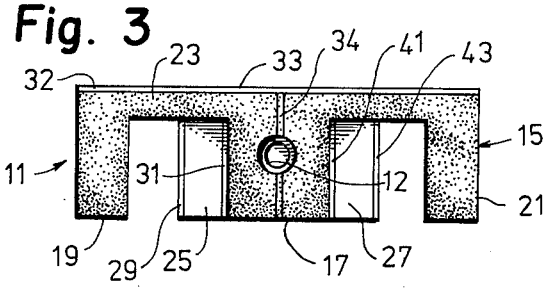
FIG. 3 is a top plan view of the club head of FIG. 1.

Indicia 41 and 43, not visible in FIG. 1, are shown in FIG. 3. Also in FIG. 3, shaft 13 (and any corresponding shank or hosel portion of the putter head intended to be connected to the shaft) is omitted and therefore socket or hosel 12 is seen. It is intended that various other hosel-shaft combinations may also be employed and in some instances it may be preferable to utilize the more "conventional" structures if the "straight through" joinder of shaft to club head would interfere with weight placement in the putter head.

Figure 4:
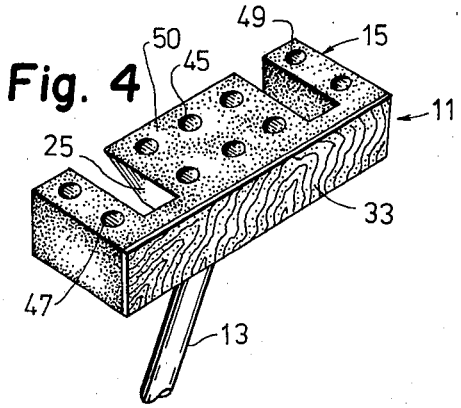
FIG. 4 is a perspective view of the club head-shaft combination of FIG. 1, seen from a position below and in front of the club head.

In FIG. 4 the nature of the leading surface 33 has been shown as wood, which is the composition of the leading surface portion 32. Wood gives a different feel from metal when the ball is stroked and such may be preferred by some golfers and may assist them in developing more consistent putting. However, other surfaces may also be employed and the surface may be the same as and integral with the putter head body. As with wedge 54, portion 32, when present, may be affixed to the rest of the club head by any suitable means, such as adhesive, cement, screws, snap fittings or tongue-and-groove joints. In FIG. 4 and in the other figures of this drawing the nature of the other surfaces of the club head is also indicated, preferably as being of anodized aluminum or similar appearing surface, which may, compared to smoother and shinier surfaces, limit reflections and shadow contrasts, thereby facilitating comparisons of areas 25 and 27 (or corresponding exposed wedge surfaces) so as to aid in aligning the club head. However, other surface materials may be employed, including painted, etched, plated, plastic and cloth. Also, such surfaces can be the same as the putter head, which can be of zinc, brass, bronze, stainless steel, steel, copper or synthetic organic polymeric material. Openings 45, 47 and 49 are positioned in the middle and end trailing portions of the club head and weights in them provide additional mass and thereby aid in maintaining the club head in its desired stroke path before and after contact with the ball. The inboard weight increases the mass behind the "sweet spot," to improve feel and stroking consistency, and the outboard weights tend to prevent rotation of the putter face during taking back and stroking movements. The weights used usually of lead, extend vertically upward but normally will not penetrate the top surface of the club head and will not be visible at such surfaces. They are preferably located in the upper portions of the openings shown so as to raise the putter mass center, in which case the weight cavities are vacant near the bottoms thereof. If desired, such openings may be closed off by a thin sole plate, not shown, fastened to the putter bottom. Such a sole plate or equivalent could be employed to cover only the weight cavities or could cover the entire putter lower surfaces but such latter embodiment would detrimentally lower the club head center of gravity and would diminish alignment and stroking advantages of the invented structure, and so is not preferred.

Figure 5:
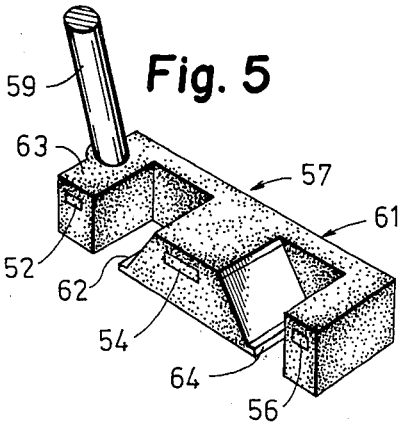
FIG. 5 is perspective view of a modification of the club head of FIG. 1, with a part of a shaft attached thereto in a different position.

In FIG. 5 shaft 59 of golf club 57 is shown joined to club head 61 at near (to a right handed golfer) end portion 63 thereof instead of to a middle portion like that to which the shaft was joined in FIG. 1. While the balancing of the golf club is usually considered to be improved when the shaft or club head shank is more centrally located, some golfers may prefer the embodiment illustrated in FIG. 5, and the alignment, center of gravity and moment of inertia features thereof will still be functional and will be improvements over comparable putters. Instead of the fastening of the handle to the club head shown other conventional joinders known in the putter art may also be used. Another change from the club head shown in FIG. 1 is in the horizontally extending steps 62 and 64 extending from the bottoms of slopes 25 and 27. Such steps may assist in centering the putter and may facilitate its manufacture. Also, rectangular weights 52, 54 and 56 are shown.

Figure 6:
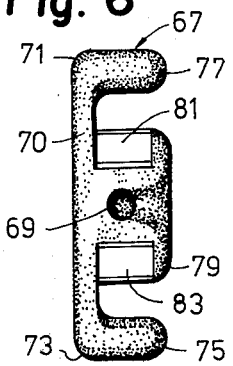
FIG. 6 is a top plan view of another such modification.

The club head of FIG. 6 is essentially like that of FIG. 3 with the exception that the corners of the club head, as viewed vertically, are rounded, and there is no wood surface portion or other such portion different from the body material. Thus, club head 67 includes a leading side portion 70 with rounded corners 71 and 73, end trailing portions 75 and 77, which are rounded, as shown, and middle trailing portion 79, similarly rounded. Inset downwardly and endwardly (or downwardly and outwardly) extending planar surfaces 81 and 83 do not extend to the extreme back of portion 79 but may be so extended in other versions of the invention. Hosel or socket 69 is essentially centrally positioned with respect to the middle part of the club head for direct insertion and fastening of the lower portion of the golf club shaft or of any suitable shank for the club head to which the shaft may be attached (such shank being intended to be permissibly included within the description of the club given herein). Normally, in most versions of the club head, socket 69 will be located in the central part of the club head middle portion, as indicated, or toward the leading side portion of the club, but usually will not extend into such leading side portion. Such locations are chosen for best balancing of the club but, as when off-set shank or hosel structures are utilized, such positioning may be altered.

Use of the present putter is simple and requires no special training. Initially, the golfer takes his normal putting stance, attempting to align his head with the putter and the ball, usually so that his head is positioned over the ball and at the mid-point of the putter. Referring to the club illustrated in FIG. 1, as an example, he will align groove or mark 34 with the center of the golf ball, with club head surface 33 almost touching the ball. Then he will move his head into position and compare the apparent areas of slopes 25 and 27. If it appears to him that slope 25 is larger he will move his head slightly forward (transverse to the putting line) in the direction of trailing end 21. If the area of slope 27 appears larger he will move his head in the other direction. This will be done until the areas appear to be the same or in apparent ratio considered most desirable by the particular golfer, to give him best putting results. After such positioning, the putter will be brought back in the normal way and the ball will be stroked, with the alignment groove or mark 34 being kept on the desired path initially to be followed by the ball.

In the various embodiments of the invention the club head may be made of any suitable material but will usually be of a metal, such as aluminum or aluminum alloy (either can be preferred), brass, zinc, copper, bronze, lead, steel (usually chrome or nickel plated) or stainless steel. However, it is within the invention to employ any of the suitable synthetic organic polymeric plastic materials, such as nylon, fiberglass reinforced polyesters and polyethers, polyacrylates, epoxies, polypropylene, and mixtures thereof. Graphite also may be used and any of the heads made may be suitably colored, painted, or otherwise surface treated, as by anodizing. Although plastics, even reinforced or filled plastics, are normally lighter than desirable, with the employment of weights inserted therein they may be made of acceptable weights. The weighting substance may be any suitable material with a density greater than 7 g./cc. and greater than that of the rest of the club head. Lead will usually be the preferred weighting material but mercury is also useful, especially when it is employed to only partially fill (usually to the extent of 30 to 90%, preferably 40 to 75%), a cavity (preferably horizontal) in the head, extending forwardly therein (in the direction of club movement). In such cases its momentum helps to slow transition from "backswing" to stroke and helps to carry the club head "through the ball" after contact.

The structure and dimensions of the present club head may be changed to suit personal preference but it is usually preferred that such variations be within the ranges allowed by the Rules of Golf established by the United States Golf Association. Preferably, the overall shape of the club head will be a regular parallelepiped, flat on all external surfaces but with two openings therein, so that the club head resembles a squared or square W, or an E, when viewed from the top or bottom. However, the ball contacting surface may be slightly inclined, as was previously mentioned. Apart from the alignment assisting sloping internal walls, which can be curved but are also preferably flat, other internal walls are preferably at right angles to the major faces and also are flat. Furthermore, it is preferred that the club head be symmetrical in such respects. However, in particular cases the end portions may be different, the middle portion of the club head may be moved toward one side or the other and the sloping alignment walls of the middle trailing portion of the club head may be sloped differently. Thus, such middle trailing portion, when viewed from the rear thereof, may be an irregular trapezoid instead of the preferred regular trapezoid. When it is a regular trapezoid (or otherwise) the base angles are in the range of 45° to 85°, preferably 55° to 70°. Also, the shapes of other inner walls of the club head may be altered, with angles thereof being changed and in some cases with such walls being curved. Similarly, in some circumstances the sloping portions of the alignment walls may also be curved or otherwise modified and in some instances, in accordance with broader aspects of this invention, such "alignment walls" may be vertical, with other mechanisms being employed for aligning.

Normally the dimensions of the present golf club will be within the following ranges:

length: 9–12 cm.
width: 2.2–7 cm.
height: 1.5–5 cm.

The ratios of length:width:height will normally be in the range of 4:1.0–2.4:0.6–1.2, with preferred such ratios of dimensions being about 4:2:1. The leading side portion of the putter will normally be from 0.3 to 0.6 cm. thick and the thickness of the surface veneer or plate (preferably wood), if used, will be from 0.1 to 0.3 cm., with such ranges preferably being 0.3 to 0.5 and 0.1 to 0.2 cm., respectively. The ratio of leading side portion thickness to trailing portions' length (both measurements being along the stroke axis of the club) will normally be in the range of 0.1 to 0.4, preferably 0.2 to 0.3. The bottom openings, along the club head axis (transverse to the stroke), will usually be from 40 to 80%, preferably 50 to 70% of the corresponding top openings.

The weight of the club head may also be varied but will normally be within the range of 390 to 580 grams. The locations of the weights and their comparative densities and volumes will preferably be such that the vertical center of gravity of the putter head will be in the upper or middle part thereof and the location of such center of gravity and the putter height will preferably also be at or above a midpoint of a golf ball being stroked and most preferably will be at or greater than 2.1 or 2.2 cm. from the club bottom face.

While it is often preferred, for a particular contact feel and putting control, that the surface of the present putter head be of wood or of material of similar characteristics, it is within the invention (and such is illustrated in FIG. 6) to have the surface of a different club material or of another suitable material or materials. Similarly, while an anodized aluminum surface is highly desirable, similar surface treatments of other metals or materials may be employed and in some instances even very shiny surfaces, such as plated metal surfaces, may be acceptable.

With respect to the present club head and club, while "illegal" designs may be within the present invention, it is intended for the invented products to comply with the Rules of Golf so that the improved putting scores obtainable will be acceptable under such rules. Therefore, various configurations of the golf head portions that are controlled by the Rules of Golf should be within the specifications thereof. For example, the attitude of the putter face, which, in accordance with the present invention, is substantially vertical, may be inclined forwardly or backwardly up to 10° and will still be within the Rules of Golf. It is intended that such inclinations be within the present invention and they are considered to be "substantially vertical." However, it is preferred that such inclinations be limited to 5° in either direction. Similarly, club head shank and shaft inclinations and shapes are preferably within the permissive range of the Rules of Golf.

The present club head and club are advantageous over other putters in several ways, some of which have previously been mentioned or suggested. With portions of the club trailing at the ends and in the center, weight distribution is such as to favor a higher moment of inertia while yet maintaining a concentration of mass along the central stroke axis of the club head. The presences of openings along the bottom surfaces of the club head, with sides of said openings at such surfaces being parallel to the desired direction of club travel, also physically aid in maintaining a straight club head path if the club brushes against the grass on a green. The alignment of the golfer's head with the club and ball, obtainable by the viewing of comparable surfaces of the club and comparing areas seen, accomplishes in an easy and simple manner the positioning of the golfer's head without adding special equipment or unusual and more readily breakable structures to the club head. The club head resulting, with its various advantages, is still aesthetically attractive and is acceptable to golfers. The squared shape, with multiple walls thereof parallel to or at right angles to the desired axis of ball roll, helps to guide the putting stroke. Also, the club surfaces are essentially free of glare, the ball contacting surface gives a good "feel" of the ball on contact and the higher center of gravity aids in imparting an improved roll to the ball.

Preferred embodiments of the invention have been shown in the drawing, with a highly preferred embodiment thereof being shown in FIGS. 1, 3 and 4, but other modifications can desirably be made and the product will still be within the invention. Some of these will now be described.

Although it is preferred that the present golf club head be of square W shape, with all the surfaces being at right angles to adjoining surfaces except for the mentioned slopes, it is within the invention to modify such surface angles and characteristics, and to curve them in some cases. It is important for the openings between the middle trailing portion and the end trailing portions to extend through the club head bottom surface but in some cases such surface section may be continuous or may be continuous for a portion of the bottom, leaving partial openings in such surface. The sloping areas may be sloped at different angles and the slopes may begin lower where they extend from the middle trailing portion. Such sloping portions may be curved under some circumstances. Indicia for defining the areas to be compared may include paint lines, grooves or other means at the locations illustrated in the figures of this drawing or a line may be painted on the top surface of the putter head near the termination of the slope, and at the bottom of the slope the portion of the putter head adjacent the bottom thereof may be extended slightly toward the putter end, thereby defining another boundary. It is preferred that a major proportion of the surface, and in some cases, all of it, except for the ball contacting putting surface, be anodized or similarly modified. Yet, lesser proportions thereof and in some cases no such treated surface, may be present. Instead of individual cylindrical weights being employed in matching cavities, the cavities may be consolidated, and single larger weights of different shapes, e.g., regular parallelepipedal, may be employed instead. Also, instead of the shaft of the putter extending directly into a hosel in the putter head such head may include a shank portion intended for fitting to the shaft, or the shaft may be suitably modified, all of which are within the meaning of "shaft."

The invention has been described with respect to preferred embodiments and modifications thereof but it will be evident that it is not limited to these because one of skill in the art, with the present description before him, will be able to utilize substitutes and equivalents without departing from the invention.

This application describes and claims an invention which is the subject of Disclosure Document No. 093,130, filed Aug. 13, 1980 by the present inventor and entitled GOLF CLUB DESIGN AND RELATED FITTING APPARATUS PARTICULARLY RELATING TO PUTTERS. It is respectfully requested that such disclosure document be preserved indefinitely, at least until prosecution of the present patent application is concluded, and preferably for five years after issue of the patent.

What is claimed is:

1. A golf putter comprising a handle, a head and a shaft connecting said handle and head, with the putter head having a leading side portion with a substantially vertical leading surface for putting a golf ball and three separate trailing portions extending backwardly from the leading side portion, two of which extend from end portions of the leading side portion of the putter and the third of which extends from a middle portion of said leading side portion, said third trailing portion including endwardly and downwardly sloping walls, so that a golfer, putting with the putter, can be guided by them to position his head with respect to both the putter and a ball to be putted by holding his head with respect to the putter in such position that a desired ratio of areas of the sloping sides of the middle trailing portion may be viewed by him when his head is in correct position with respect to the putter and a golf ball to be putted.

2. A golf putter according to claim 1 wherein the putter head, viewed from top and bottom, is generally E-shaped, with openings between the end trailing portions and the middle trailing portion thereof, which openings extend from the upper face to the lower face of the club and are bounded by interior walls of the leading side portion and the three trailing portions of the putter head.

3. A golf putter according to claim 2 wherein the endwardly and downwardly extending walls of the middle portion are planar and the middle portion, when viewed from the trailing side thereof is trapezoidal in shape.

4. A golf putter according to claim 3 wherein the side walls of the middle portion trapezoid are at an angle from 45° to 85° from the base of the putter.

5. A golf putter according to claim 4 wherein the endwardly and downwardly extending walls of the middle portion of the putter head are marked at tops and bottoms thereof to facilitate visual comparison of areas of such walls visible to the eyes of the golfer when setting up for putting, to aid him in properly positioning his head with respect to the putter.

6. A golf putter according to claim 5 wherein the markings are at top and bottom edges of the endwardly and downwardly extending walls of the middle portion of the putter head and are horizontal lines near such top and bottom edges.

7. A golf putter according to claim 6 comprising weights of a material heavier than other material(s) of the club head in cavities in each of the three trailing portions of the club head.

8. A golf putter according to claim 7 wherein such weights extend vertically upward from the bottom of the club head and extend horizontally from the backs of the trailing portions of the club head in the upper portions thereof.

9. A golf putter according to claim 8 wherein the leading surface, which contacts the golf ball to be putted, is of wood and there are no weights in the leading portion of the putter head.

10. A golf putter according to claim 9 wherein the planar endwardly and downwardly extending walls of the middle portion have fastened thereto wedge shaped members for modifying the slope angles of such walls.

11. A golf putter according to claim 6 comprising horizontal steps extending short distances from the lower ends of the slopes toward the putter ends, and wherein such steps are marked or otherwise serve to facilitate visual comparisons of areas of the slopes.

12. A golf putter according to claim 10, the head of which is of such vertical dimensions and wherein the weights are so located that the center of gravity of the head is at a distance from the bottom of the head which is greater than half the diameter of a golf ball to be putted.

13. A golf putter head having a leading side portion with a substantially vertical leading surface for putting a golf ball and three separate trailing portions extending backwardly from the leading side portion, two of which extend from end portions of such leading side portion and the third of which extends from a middle portion of said leading side portion, the third trailing portion including endwardly and downwardly sloping walls extending from the top to the bottom thereof, which putter head, viewed from top and bottom, is generally E-shaped, with openings between the end trailing portions and the middle trailing portion thereof, which openings extend from the upper face to the lower face of the putter head and are bounded by the interior walls of the leading side portion and the three trailing portions of the putter head, so that a golfer, putting with a club comprising such putter head, a handle and a shaft connecting said handle and head, can be guided by the appearance to him or her of the sloping walls, to position his or her head in alignment with the putter head, with his or her eyes over the ball to be putted, by holding his or her head with respect to the putter head in such position that a ratio of areas of the sloping sides of the middle trailing portion may be viewed by him or her when his or her head is in correct alignment with the putter head and his or her eyes are over the golf ball to be putted.

14. A golf putter head according to claim 13 wherein the endwardly and downwardly extending walls of the middle portion of the putter head are marked near tops and bottoms thereof with horizontal lines or parts of the putter head near such tops and bottoms are so marked, to facilitate visual comparison by the golfer of areas of such walls visible to him or her when setting up for putting, to aid him or her in positioning his head properly with respect to the putter and a ball to be putted.

* * * * *